United States Patent [19]

Harlacker

[11] Patent Number: 4,666,424

[45] Date of Patent: May 19, 1987

[54] CENTRIFUGE DOOR

[75] Inventor: David S. Harlacker, Monroe, Conn.

[73] Assignee: E. I. Du Pont de Nemours and Company, Wilmington, Del.

[21] Appl. No.: 804,133

[22] Filed: Dec. 3, 1985

[51] Int. Cl.[4] ..... B04B 7/06

[52] U.S. Cl. ..... 494/60; 494/39; 220/231; 220/345

[58] Field of Search ..... 494/12, 14, 37, 39, 494/60; 220/231, 345, 346

[56] References Cited

U.S. PATENT DOCUMENTS 4,053,104 10/1977 Penhasi et al. ..... 233/11

4,196,844 4/1980 Jacobson ..... 233/1 B

*Primary Examiner*—Timothy F. Simone

[57] ABSTRACT

A centrifuge having an access opening is closed by a door having a chamber defined on the interior thereof. The chamber is connectable to a low pressure region so that the chamber may be evacuated.

11 Claims, 3 Drawing Figures

CENTRIFUGE DOOR

BACKGROUND OF THE INVENTION

1. Field of the Invention

The present invention relates to a centrifuge instrument and, in particular, to a centrifuge having an insulating door.

2. Description of the Prior Art

Some centrifuge instruments exhibit the capability of refrigerating the bowl in which the rotating member is received. This is done to control the temperature of the sample being exposed to the centrifugal force field. Exemplary of such instruments are the refrigerated centrifuges sold by E. I. du Pont de Nemours and Co., Inc. as "RC-3B," "RC-5C," or "OTD." These instruments respectively operate in the low speed, super speed and ultra speed ranges. In the latter instance the rotor bowl is evacuated while in the former two instances the bowl is not evacuated.

It is possible that when the bowl is not evacuated conduction of heat into the bowl from the ambient environment may occur and thus, may increase the sample temperature. This is perceived as disadvantageous because it both increases the refrigeration requirements and drives sample temperature beyond its desired range.

Accordingly it is believed advantageous to provide a structure whereby heat conduction from the exterior of the instrument to the refrigerated bowl is minimized.

SUMMARY OF THE INVENTION

The present invention relates to a centrifuge instrument of the type wherein access to the rotor is afforded through an access opening provided in the housing of the instrument. The opening is closed by a door slidably mounted to the housing of the instrument. Defined on the interior of the door is a hollow chamber having a dimension to exhibit a size and configuration substantially coextensive with the size and configuration of the access opening in the housing. The hollow chamber is connectable to a low pressure region whereby the interior of the chamber may be evacuated thus effectively insulating the door. As a result heating of the rotor bowl by conduction of heat through the door is inhibited.

BRIEF DESCRIPTION OF THE DRAWINGS

The invention will be more fully understood from the following detailed description thereof taken in connection with accompanying drawings which form a part of this application and in which.

DETAILED DESCRIPTION OF THE INVENTION

Figure 1:
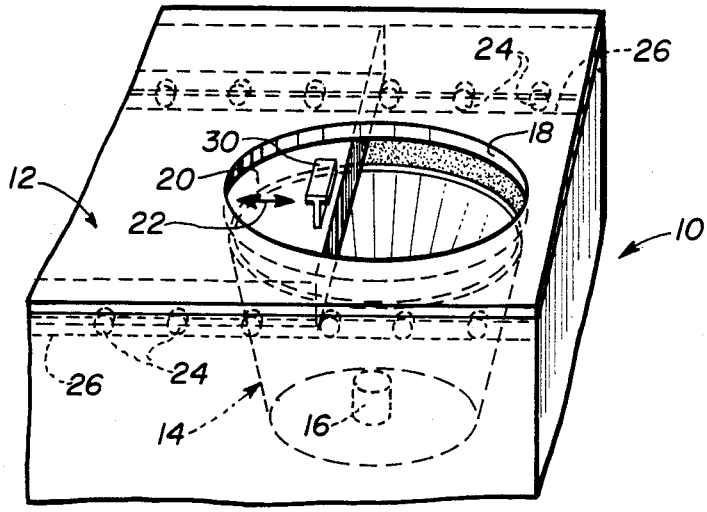
FIG. 1 is a perspective view of the upper portion of the housing of a centrifuge instrument having a door structure in accordance with the present invention.
Figure 2:
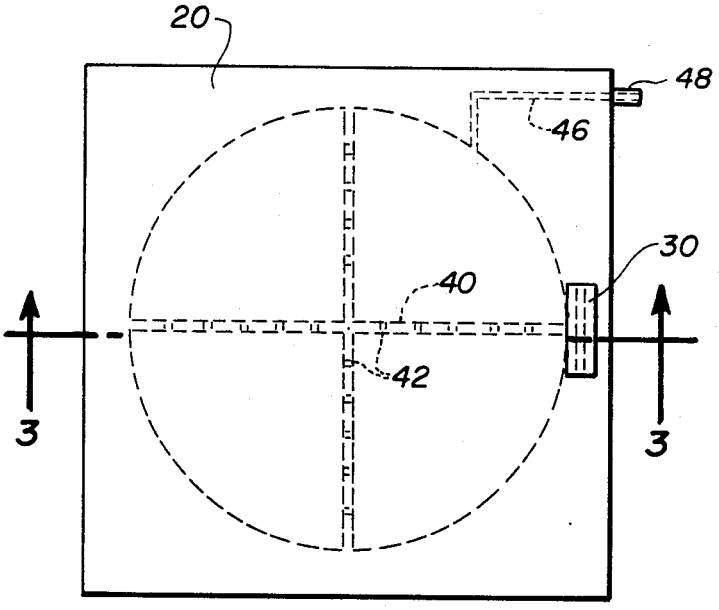
FIG. 2 is a plan view of the door in accordance with this invention.
Figure 3:
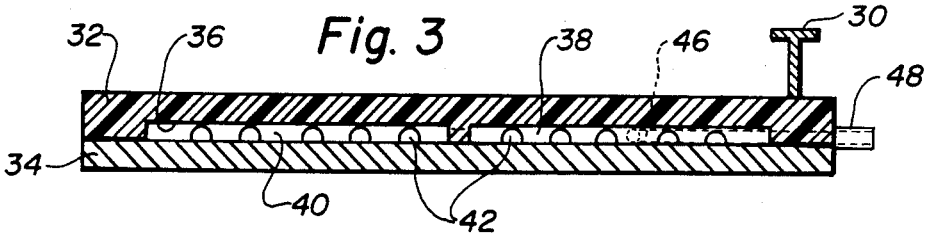
FIG. 3 is a sectional view taken along section lines 3—3 in FIG. 2.

Throughout the following detailed description similar reference numerals refer to similar elements in all Figures of the drawings.

With reference to FIG. 1 shown is a highly stylized view of a centrifuge instrument generally indicated by reference character 10. The centrifuge includes an outer casing or housing 12 which encloses a bowl 14 therein.

A rotating member, or rotor (not shown), may be received within the bowl 14 for rotation therein on a drive connection 16 in a manner appreciated by those skilled in the art. Access to the bowl 14 is afforded through an access opening 18 provided in the upper surface of the housing 12. The bowl 14 may be provided with a suitable evaporator arrangement whereby the temperature of the rotor and any sample carried therein may be regulated, all of the foregoing being well understood by those with skill in the art.

The access opening 18 may exhibit any suitable configuration. The opening 18 is covered by a door 20 which embodies the present invention. The door 20 is illustrated as being slidably movable in the direction of the arrows 22 beneath the upper surface of the housing 12 from an open to a closed position. In the closed position the door 20 completely covers the access opening 18. To facilitate this motion the door 20 is provided with suitable rollers 24 which may be mounted to the door 20 or otherwise received in tracks 26 mounted in the housing 12. A handle 30 facilitates manipulation of the door 20. It should be appreciated, of course, that any other mounting configuration for the door 20 may be utilized and remain within the contemplation of the invention.

The door 20 is fabricated from an upper plate 32 and a lower plate 34. In the preferred case shown in the drawing the upper plate 32 has a recess 36 machined or otherwise provided therein. The lower plate 34 is screwed or otherwise secured to the upper plate 32 thereby to define a totally enclosed chamber 38 on the interior of the door 20. A spacer 40 is provided in the chamber 38. The spacer 40 has gaps 42 formed therein whereby the entire chamber is in fluid communication. The spacer 40 may be formed as a projection from the upper and/or lower plates or as a separate member, or any other convenient manner. The upper plate 32 in the preferred embodiment is fabricated from a reinforced thermoplastic material while the lower plate 34 is stainless steel. The chamber 38 is sized and configured to overlap entirely the access opening 18. Thus, when the door 20 is in the closed position only that portion of the upper plate 32 beneath which the chamber 38 is defined is presented to the ambient environment.

It should be appreciated that although the chamber 38 is defined in the preferred case by the recess in the upper plate 32 and closed by the lower plate 34 it lies within the contemplation of the invention to otherwise define the chamber 38 within the door 20. For example the chamber 38 may be defined by cooperating recesses suitably formed in both the upper and lower plates 32, 34 or by a recess only in the lower plate 34. In addition the chamber 38 may be formed by spacing apart the plates 32, 34 (whether or not one or both is recessed) by suitable border pieces. The chamber 38 may be of any predetermined convenient height, typically on the order of 0.250 inch. The height profile of the chamber 38, although shown as uniform throughout, may be contoured in any predetermined manner.

The chamber 38 communicates with a low pressure region through a vacuum passage 46 terminating in a vacuum port 48. The low pressure region may be defined by any suitable means, such as a vacuum pump. As a result of the dimensional overlap of the chamber 38 over the opening 18, when the chamber 38 is evacuated (to a vacuum on the order of twenty-eight inches Hg) conduction of heat into the bowl 14 is essentially precluded. The spacer 40 prevents the chamber 38 from being collapsed by atmospheric pressure when the chamber 38 is evacuated. Of course, if the material of the upper plate 28 is fabricated of a material that is less susceptible to flexure the spacers may be eliminated.

Those skilled in the art, having benefit of the teachings of the present invention, may effect numerous modifications thereto. These and other modifications are to be construed as lying within the scope of the present invention as defined by the appended claims.

What is claimed is:

1. A centrifuge comprising:

a housing having an access opening of a predetermined size and configuration; and a door movable with respect to the housing from an open to a closed position, in the closed position the door completely covering the access opening, the door having an enclosed chamber formed on the interior thereof that is sized and configured to overlap the access opening, the chamber being connectable to a low pressure region thereby to evacuate the chamber.

2. The centrifuge of claim 1 further comprising a spacer mounted within the chamber to support the door when the chamber is evacuated.

3. The centrifuge of claim 1 wherein the door comprises an upper plate and a lower plate, one of the plates having a recess therein and the other of the plates covering the recess thereby to define the enclosed chamber therebetween.

4. The centrifuge of claim 3 further comprising a spacer mounted between the upper and lower plates to support the same when the chamber is evacuated.

5. The centrifuge of claim 4 wherein the upper plate is plastic and the lower plate is stainless steel.

6. The centrifuge of claim 3 wherein the upper plate is plastic and the lower plate is stainless steel.

7. The centrifuge of claim 6 wherein the height of the chamber is uniform.

8. The centrifuge of claim 5 wherein the height of the chamber if uniform.

9. The centrifuge of claim 4 wherein the height of the chamber is uniform.

10. The centrifuge of claim 2 wherein the height of the chamber is uniform.

11. The centrifuge of claim 1 wherein the height of the chamber is uniform.

* * * * *